United States Patent [19]

Meichsner

[11] 3,955,966

[45] May 11, 1976

[54] METHOD FOR DISPENSING A FLUIDIZABLE SOLID FROM A PRESSURE VESSEL

[75] Inventor: Walter Meichsner, Homberg, Germany

[73] Assignee: August Thyssen-Hutte AG, Duisburg, Germany

[22] Filed: July 30, 1974

[21] Appl. No.: 493,202

Related U.S. Application Data

[63] Continuation-in-part of Ser. No. 448,800, March 6, 1974, Pat. No. 3,807,602, which is a continuation of Ser. No. 270,397, July 10, 1972, abandoned.

[52] U.S. Cl. ..... 75/58; 75/53; 75/55

[51] Int. Cl.[2] ..... C21C 7/02

[58] Field of Search ..... 75/58, 53, 55

[56] References Cited

UNITED STATES PATENTS

| | | | |
|---|---|---|---|
| 1,922,037 | 8/1933 | Hardy | 75/58 |
| 2,779,675 | 1/1957 | Vennerholm | 75/55 |
| 2,803,533 | 8/1957 | Bieniosek | 75/55 |
| 3,368,885 | 2/1968 | Volianik | 75/55 |
| 3,551,139 | 12/1970 | Schokkenbroek | 75/53 |
| 3,575,695 | 4/1971 | Miyashita | 75/58 |
| 3,598,573 | 8/1971 | Freissmuth | 75/53 |
| 3,702,151 | 11/1972 | Blok | 75/58 |
| 3,716,352 | 2/1973 | Ooi | 75/58 |

*Primary Examiner*—Peter D. Rosenberg
*Attorney, Agent, or Firm*—Burgess, Dinklage & Sprung

[57] ABSTRACT

An improvement in the method of desulfurizing molten pig iron by forming a fluidized stream of a solid desulfurizing agent consisting of finely divided calcium carbide which is contained in a pressure vessel which comprises a discharge connected to an immersion lance by a conveying pipe, by injecting a fluidized gas at a pressure upwardly into the desulfurization agent, withdrawing the resultant fluidized desulfurizing agent from the pressure vessel, introducing a separate stream of gas into the conveying pipe and conveying said fluidized desulfurizing agent together with the fluidizing and feeding gases into the pig iron through said immersion lance, determining the amount of the solid desulfurizing agent, and the through-flow quantity of gas flow, being the sum of amount of fluidizing gas and the amount of feeding gas, and maintaining a predetermined gas/solid ratio which improvement comprises using as the desulfurizing agent finely divided calcium carbide mixed with a solid material which decomposes or evaporates at the temperature of the molten pig iron thereby evolving a gas and withdrawing the fluidized desulfurization agent from said pressure vessel and feeding it into the molten pig iron at a rate of between 70 and 250 kilograms per minute and maintaining the gas/solid ratio at a value in the range of 2 to 12 normal liters per kilogram.

22 Claims, 2 Drawing Figures

METHOD FOR DISPENSING A FLUIDIZABLE SOLID FROM A PRESSURE VESSEL

CROSS-REFERENCE TO RELATED APPLICATION

This application is a continuation-in-part of co-pending application Ser. No. 448,800 of Mar. 6, 1974, now U.S. Pat. No. 3,807,602, entitled Method and Apparatus for Dispensing A Fluidizable Solid From A Pressure Vessel, which, in turn, is a continuation of Ser. No. 270,397 of July 10, 1972, now abandoned the disclosure of which is hereby incorporated herein by reference.

BACKGROUND OF THE INVENTION

1. Field of the Invention

This invention relates to the desulfurization of molten pig iron employing a desulfurization agent which comprises calcium carbide and a solid material which decomposes or evaporates at the temperatures of the molten pig iron to be desulfurized to produce a gas which desulfurization agent is introduced into the molten pig iron at a relatively high rate of between 70 and 250 kilograms per minute and at a relatively low gas/-solid ratio. More particularly, this invention relates to the desulfurization of molten pig iron employing a fluidized stream of a desulfurizing agent which is a mixture of calcium carbide and a decomposable or evaporatable solid material which produces a gas at the temperature of molten pig iron.

2. Discussion of the Prior Art

For the last two decades it has become common to carry out external desulfurization of hot metal. Because of rising prices of coke it has become necessary in the last ten years to intensify efforts to reduce coke rates. This has led to the development of new technologies for injecting fuels in the blast furnace and at the same time decreasng the basicity of the slag. As a result the sulfur content of the hot melt has increased making it necessary to intensify external desulfurization techniques. A further reason for carrying out such external desulfurization lies in the rising demands for hot metal with low sulfur content for the steel shop in order to meet the requirements of the consumer.

The injection of desulfurizing agents such as calcium carbide into a molten melt bath to effect desulfurization is broadly known. In parent Application Ser. No. 270,397 there is described an apparatus which permits the fluidization of such a desulfurization agent and the injection of the same into the metal bath through a lance which passes through the surface of the molten metal.

It has become desirable to provide a means by which the sulfur content is reduced to as low as possible and by which the resultant steel has a consistently low sulfur content. Heretofore it was believed that the molten pig iron could be desulfurized employing a fluidized stream of solid which was injected into the molten metal at a rate exceeding 25 feet per second at the point of delivery while utilizing a stream having an apparent density of at least 1 pound per cubic foot (U.S. Pat. No. 3,001,864 to Muller et al.). Unfortunately, such a technique has not been accepted by the industry inasmuch as the molten pig iron has not been adequately desulfurized.

Other procedures for the desulfurization of molten metals have utilized inert gases to effect fluidization of the desulfurization agent, these gases being materials such as nitrogen, argon, helium and the like. The rate at which the calcium carbide has been fed to the molten metal has been around 6.5 lbs. of calcium carbide per minute (U.S. Pat. No. 2,803,533). It is also been proposed to conduct the desulfurization of hot metal using a variety of process conditions including an injection rate of desulfurization agent into the molten pig iron of about 120 lbs. per minute.

Thusfar, none of these techniques have provided a commercially feasible method of desulfurizing molten pig iron. The reason lies in the fact that when injecting calcium carbide in melts, it is necessary that the liquid metal be mixed through the melt sufficiently in order to reach a maximum sulfur decomposition, since the calcium carbide particles swim up to the surface very quickly in the melt due to the great difference in density and are thus withdrawn from the reaction.

To increase this mixing, a desulfurizing agent has already been proposed, which consists of calcium carbide and a gas-separating addition (U.S. Pat. No. 3,598,573). However, it has proven that the use of this desulfurization agent alone is not sufficient in and of itself for maximum desulfurization improvement.

One object of the invention, therefore, is to provide a desulfurization process with which melts can be treated with a high utilization degree of the desulfurization agent, and which, moreover, permits the exact adjustment of any sulfur content in the melt even to extremely low levels. Another object of the invention is to provide a process which permits the injection of large amounts of desulfurization agent in a relatively short time without impairing the desulfurization effectiveness, in order to be thus able to desulfurize large amounts of pig iron without disturbing the operation.

SUMMARY OF THE INVENTION

The long felt desideratum in the desulfurization of molten pig iron is answered by an improved process for the desulfurization of pig iron by forming a fluidized stream of a solid desulfurizing agent comprising finely divided calcium carbide, which is contained in a pressure vessel, which vessel comprises a discharge connected with an immersion lance by a conveying pipe, by injecting a fluidizing gas upwardly into the fluidizing agent, withdrawing said fluidized desulfurizing agent from said pressure vessel, introducing a separate stream of a feed gas into a conveying pipe and conveying the resultant fluidized desulfurizing agent together with the fluidizing and feeding gases into the pig iron through said immersion lance, determining the amount of solid desulfurizing agent, and the through flow quantity of gas flow, said through flow quantity of gas being the sum of the amount of fluidizing gas and the amount of feeding gas, maintaining a predetermined constant gas/solid ratio, which improvement comprises employing as the desulfurizing agent a finely divided calcium carbide mixed with a solid material which decomposes or evaporates at the temperature of the molten pig iron thereby evolving a gas and withdrawing the fluidized desulfurizing agent from said pressure vessel and feeding said fluidized desulfurizing agent into said molten metal at a rate of between 70 and 250 kilograms per minute and maintaining the gas/solid ratio to value in the range of 2 to 12 normal liters per kilogram.

DESCRIPTION OF SPECIFIC EMBODIMENTS

Surprisingly, it was found, during the development of the method and apparatus for dispensing a fluidizable solid described in parent application Ser. No. 270,397, that further improvement of molten pig iron desulfurization can be achieved if the finely divided solid desulfurization agent, aside from a predominant portion of calcium carbide, contains a material which decomposes or evaporates at the temperatures of the pig iron melt and which gives off a gas in the process. By the term "gas" there is contemplated carbon dioxide, hydrogen, water vapor and the like.

It became further evident that when using finely divided calcium carbide which is mixed with a gas-evolving material that the amount of desulfurizing agent to be charged into the molten pig iron can desirably be increased to 70 to 250 kilograms per minute and that excellent desulfurization occurs at these high injection rates when the gas/solid material ratio is kept at a value of between 2 and 12 normal liters per kilogram.

By using a desulfurization agent containing a substance which splits off gas or water optimum turbulence is provided when the desulfurizing agent is injected into the molten pig iron at 70 to 250 kilograms per minute. With an injection rate less than 70 kg./minute only minor turbulence in the pig iron results. The particles of desulfurizing agent move upward in the molten metal as they leave the lance mouth or orifice. If the turbulence is increased to 70 to 250 kg./minute the desulfurizing agent not only distributes itself better but it also remains longer in the melt through increased circulation. If, on the other hand, the upper limit for the injection rate is exceeded, the turbulence is too strong and pronounced in the area of the rising blister column which results in the formation of large blisters by coalescence of the blisters. This pulls the desulfurizing agent out unused from the pig iron.

In the operation of the subject process, it is necessary that a suitable turbulent pig iron circulatory movement be produced. This turbulence is adjusted to the amount of desulfurizing agent introduced into the melt. It is desired to provide a rolling pig iron movement to insure maximum desulfurizing agent pig iron content. Where large amounts of pig iron are employed the injection rate of the desulfurization agent is not changed. What is increased is the portion of the gas or water separating material added together with the desulfurizing agent. Where a small vessel is employed containing a smaller amount of pig iron the diameter of the rolling pig iron movement is adjusted to the smaller vessel measurements by decreasing the portion of the gas or water vapor separating addition material in the desulfurizing agent.

One facet of the present invention involves the use of a desulfurizing agent which is a mixture of a calcium carbide powder and an agent which decomposes or evaporates to form a gas. The production of a gas in situ within the melt effects a considerable turbulence in the metal bath which leads to a comprehensive distribution of the calcium carbide powder within the metal melt which in turn leads to a considerable improvement of the desulfurization effect. This gas allows more metal to come into contact with desulfurization agent and allows a more complete desulfurization of the molten metal. Moreover by use of such a desulfurizing agent the quantity of agent which can be introduced into the molten metal can be increased to between 70 and 250 kilograms per minute thereby facilitating the desulfurization reaction. This injection of desulfurizing agent is accompanied by maintaining a relatively low gas/solid material ratio of 2 to 20, more especially 2 to 12 normal liters, e.g., 4–10 per kilogram, preferably 2 to 8 normal liters per kilogram and most desirably 4 to 6 normal normal liters per kilogram. Under such conditions the fluid desulfurizing agent can be withdrawn from the pressure vessel and charged into the molten metal bath at an injection rate of 80 to 140 kilograms per minute and more preferably between 100 and 140, e.g., 100 and 120 kilograms per minute.

By such process according to the invention, one can achieve a high utilization degree of the desulfurization agent despite the use of this high injection rate. The process can be exactly maintained to the desired extremely low sulfur content. The high injection rate results in short treatment times even with relatively high amounts of metal, and thus increases the productivity of the entire operation.

As indicated above the desulfurization agent comprises calcium carbide and a solid which decomposes into a gas or evaporates to form a gas. There is contemplated within such description natural calcium carbonates which decompose to form carbon dioxide. Particularly contemplated is limestone to which carbon can be admixed. Additionally there is contemplated chemically precipitated calcium carbonate as well as calcium-magnesium carbonate, raw dolomite or magnesium carbonate as well as raw magnesite. Carbon can be admixed to any of these components.

There is also contemplated the use of synthetic polymeric substances notably organic polymers containing hydrogen, e.g., polyolefins such as polyethylene and polypropylene, polyamides, polystyrene and polyacrylonitrile, either individually or in mixtures, as well as urea, quanidines, biquanidines, dicyandiamide, dicyandiamidine and melamine.

Also contemplated are substances which yield water when in contact with the molten metal. Materials which fall within this category include: calcium hydroxide (hydrate of lime, $Ca(OH_2)$), alkaline earth borates containing water of crystallization, such as colemanite and pandermite, aluminum hydroxides, perlite, kaolin, clays and other such minerals, carbohydrates such as sugar and starch, solid organic compounds such as phthalic acid and glycollic acid, organic polymers containing OH radicals such as polyvinylalcohol and polyvinylacetate and polyalcohols such as sorbitol.

Additionally, it has proven advantageous to utilize a desulfurization agent containing a strong deoxidizing (reducing) agent as additional component as, for example, aluminum or calcium, especially when the gas evolving agent evolves $CO_2$. This is desirable since the $CO_2$ gas so evolved or, water vapor in the case of a water yielding material, act oxidizingly when formed in situ. On one hand, the sulfur transition from the metal to the calcium carbide can be decreased and, on the other hand, a portion of the calcium carbide can react with the oxygen which develops from the carbon dioxide or water vapor to form calcium oxide. This is undesirable since calcium oxide has a considerably less desulfurization effect than calcium carbide. It is desirable to include in the desulfurizing agent a material which will take up the oxygen or water vapor formed in situ after it has effected the initial turbulence.

BRIEF DESCRIPTION OF DRAWINGS

Referring to the attached drawings.

Figure 1:
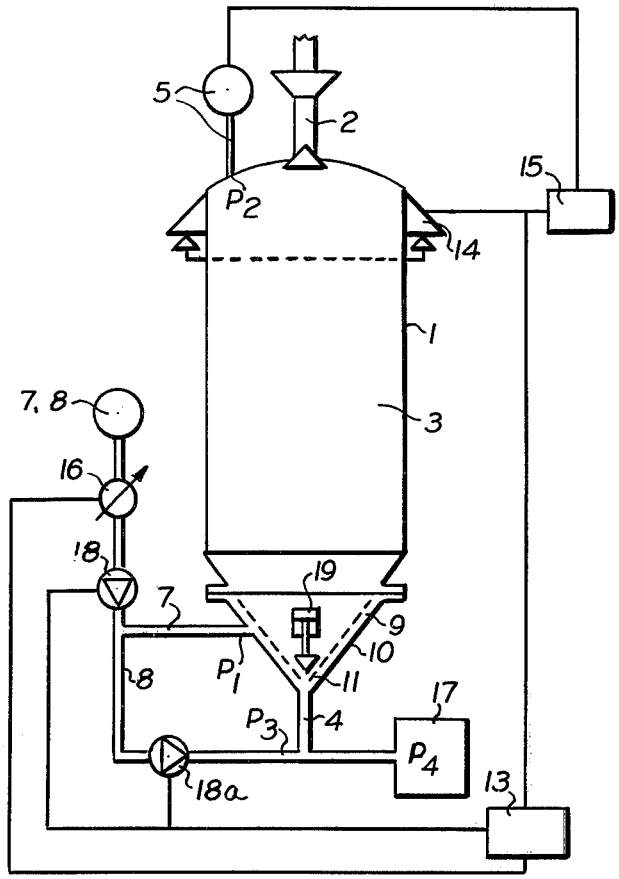
FIG. 1 is a cross-sectional diagramatical view of an apparatus of the present invention employed to carry out the claimed process.
Figure 2:
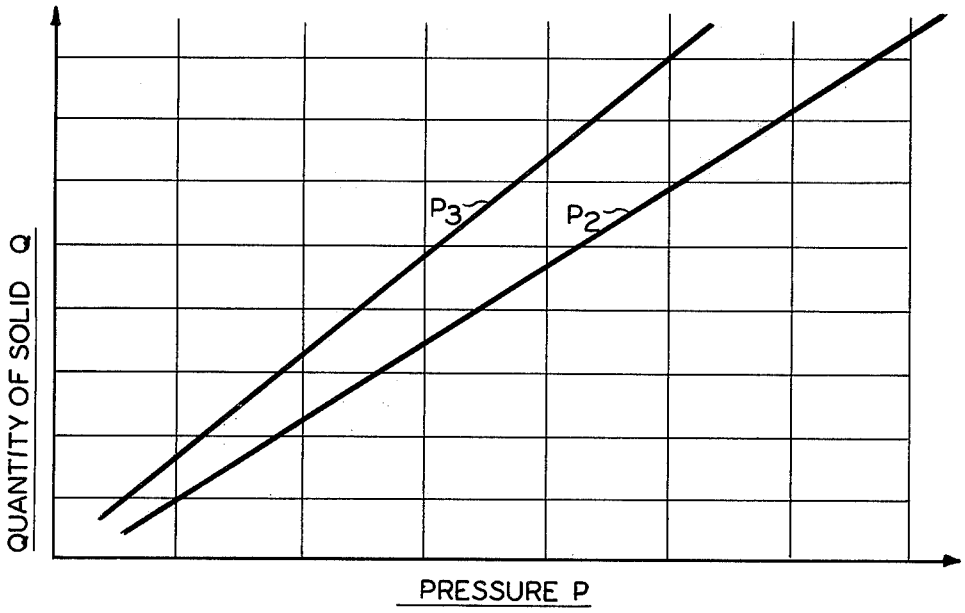
FIG. 2 is a draft showing the amount of conveyed material against pressure.

There has been described in parent application Ser. No. 270,397 the manner by which the apparatus described therein is employed to dispense a controlled quantity of a solid material into a conduit. The apparatus functions to fluidize solid material maintaining therewithin. Briefly the apparatus comprises a pressure vessel 1 with a closable charging aperture 2 and a discharge 4 closable by a plug 19 for the solid 3. For fluidization, the double-walled bottom end is composed of the vessel bottom end 10, the second gas pervious bottom end 11 and the chamber 9 situated therebetween. Opening from above into the pressure vessel 1 is a first gas pressure supply 5 under a pressure $P_2$, into the chamber 9 opens the gas pressure supply 7 at pressure $P_1$. This gas is also known as the fluidizing gas $P_1$. Into the discharge 4 there is a third gas pressure supply 8 which supplies gas at pressure $P_3$. The gas at pressure $P_3$ is known as the feed gas or together with the gas at pressure $P_1$ the solid 3 is fed into the molten metal. From the discharge 4, a conduit leads to a chamber 17 which is at the lowest pressure $P_4$. Chamber 17 is the chamber containing the molten metal and the solid 3 enters the molten metal beneath the level of the molten metal. Therefore chamber 17 exerts a back pressure against the gas in the conduit enroute thereto. The end of such conduit terminates in a lance which resists the high temperatures at which the desulfurization technique is carried out.

The conveyance of solid 3 through discharge 4 and into chamber 17 is provided by maintaining a pressure relationship of $P_1>P_2>P_3>P_4$. There is provided a weighing device 14 for metering the quantity of solid dispensed at the pressure vessel 1.

A control device 15 is associated with the weighing device 14 which compares the actual value given by the weighing device with a desired value and in accordance with the result regulates the pressure $P_2$ of the first gas pressure supplied. There is also provided in the conduits leading from the second and third gas pressure sources 7, 8 to the chamber 9 and the discharge 4 a meter 16 for metering the gas through flow quantity. This "gas through flow quantity" is the sum total of the gas at pressure $P_1$ and the gas at pressure $P_3$, i.e. the sum total of the fluidizing and heating gas. There is also provided a regulatable valve 18 or a regulatable valve 18*a*. To regulate the gas through flow quantity of the second and third gas pressure supplies from sources 7, 8 there is provided a further control device 13 which receives the actual value of the dispensed quantity of solid from weighing device 14 and sets up this value, taking into account a preset desired constant gas/solid ratio, as the appropriate desired value for the gas through flow quantity. Thus the control devices 13, 15 regulate the through flow quantities of solid and gas to maintain the preset constant ratio of 2 to 12 normal liters of gas per kilogram of solid.

In order to more fully illustrate the nature of the invention and the manner of practicing the same the following example is presented.

EXAMPLE 1

Into the device of the type described in the drawings there was charged a finely divided desulfurization agent which consisted of 70% by weight of commercial grade calcium carbide with a calcium carbide content of about 80% which calcium carbide was admixed with a gas-evolving material comprising 27% by weight lime stone and 3% of a carbon-containing material.

A torpedo ladle was filled with 200 metric tons of pig iron at the furnace. The drawn and analyzed sample showed a sulfur content of the pig iron of 0.055 weight percent. The torpedo ladle was then transferred to a desulfurization stand where the fluidized desulfurization agent was blown into the melt via a lance. The temperature of the melt was about 1,360°C.

The pressures $P_1$, $P_2$ and $P_3$ were regulated such that the desulfurization mixture was blown into the melt using pre-dried air with an excess pressure of 3.16 bar, the injection rate of the desulfurization agent into the molten pig iron being 100 kilograms per minute and the air/solid ratio being 5 normal liters per kilogram. The total amount of the injected desulfurization agent was 1,000 kilograms, i.e., 5 kilograms desulfurization agent per ton of pig iron. After a period of about 10 minutes a sample was withdrawn and analyzed. Analysis revealed that the sulfur content had dropped remarkably to 0.013 weight percent.

The desulfurization effect obtainable is not limited to the values set forth in the example. There is a direct connection between the initial sulfur content and the final sulfur content and the specific amount of desulfurization agent pertaining thereto, i.e., with a given sulfur starting content an increasingly lower sulfur end content results, the greater the specific amount of desulfurization agent is, for example expressed in kg/t pig iron. The desulfurization agent generally contains between 30 and 99 weight percent commercial calcium carbide, the balance comprising the gas evolving or evaporating material. Thus the gas-evolving material can be present in the desulfurization agent in an amount between 1 and 70%. Naturally the gas-evolving material can also contain portions of carbon. Generally speaking, however, the desulfurization agent comprises 30 to 90% commercial calcium carbide, preferably 55–75 weight percent commercial calcium carbide, the balance being the gas-evolving material. Of the gas-evolving material it is preferred that between 5 and 15 weight percent of the material be free carbon. Generally speaking, the desulfurization is carried out at temperatures between 2,200° and 2,700°F. The desulfurization is generally not dependent upon temperature and excellent low sulfur pig iron is obtained by the described desulfurization technique at temperatures within the stated range.

It has been found in practice that with the process according to the invention, the sulfur content in the pig iron can be definitely decreased as desired. For example, amounts of pig iron with a sulfur content of over 0.300% have been desulfurized to values smaller than 0.020%. Operationally, final sulfur contents have been achieved, which are below the analytically possible limit of proof, i.e., which are smaller than 0.001%. These low values are provided without any changes in the carbon, silicon, manganese and phosphorous contents. Only the nitrogen decreases by about 10 ppm, most probably due to the flushing effect caused by the evolved gas. This nitrogen decrease is commonly not desired. The fact that the nitrogen removal is slight is another advantage of the invention.

The process of the invention, therefore, by using a gas producing material together with desulfurization agent and by the selection of specific process paramaters including low gas/solid ratios and high desulfurization agent charge rate not only effects maximum sulfur reduction, but also accomplishes such reduction without significant interception of the refining process. The benefits of the invention are attributable to the above combination of factors.

What is claimed is:

1. In the method of desulfurizing molten pig iron by forming a fluidized stream of a solid desulfurizing agent comprising a finely divided calcium carbide, which is maintained in a pressure vessel, which vessel comprises a discharge connected with an immersion lance by a conveying pipe, by injecting a fluidizing gas upwardly into the desulfurizing agent, withdrawing fluidized desulfurizing agent from said pressure vessel, introducing a separate stream of a feeding gas into the conveying pipe and conveying said fluidized desulfurizing agent together with the fluidizing and feeding gases into the molten pig iron through said immersion lance, determining the amount of the solid desulfurizing agent, and the through flow quantity of gas flow, said through flow quantity of gas flow being the sum of the amount of fluidizing gas in the amount of feeding gas, and maintaining a predetermined constant gas/solid ratio, the improvement which comprises utilizing as the desulfurizing agent a finely divided calcium carbide mixed with a solid material which decomposes or evaporates at the temperature of said molten pig iron to evolve a gas and withdrawing the fluidized desulfurizing agent from said pressure vessel and feeding it into the molten pig iron at a rate of between 70 and 250 kilograms per minute and maintaining the gas/solid ratio at a value of 2 to 12 normal liters per kilogram.

2. A method according to claim 1 wherein the gas evolving material is natural calcium carbonate.

3. A method according to claim 2 wherein the gas evolving material is limestone.

4. A method according to claim 1 wherein the gas evolving material is natural calcium carbonate mixed with carbon.

5. A method according to claim 1 wherein the gas evolving material is precipitated calcium carbonate.

6. A method according to claim 1 wherein the gas evolving material is precipitated calcium carbonate containing carbon.

7. A method according to claim 1 wherein the gas evolving material is a calcium-magnesium carbonate.

8. A method according to claim 1 wherein the gas evolving material is raw dolomite.

9. A method according to claim 1 wherein the gas evolving material is magnesium carbonate.

10. A method according to claim 9 wherein the gas evolving material is raw magnesite.

11. A method according to claim 1 wherein the gas evolving material is polyethylene.

12. A method according to claim 1 wherein the gas evolving material is a polyamide.

13. A method according to claim 1 wherein the gas evolving material is dicyandimide.

14. A method according to claim 1 wherein the gas evolving material is calcium hydroxide.

15. A method according to claim 1 wherein the gas evolving material is a carbohydrate.

16. A method according to claim 1 wherein the gas evolving material is an alkaline earth borate containing water of recrystallization.

17. A method according to claim 1 wherein the gas evolving material comprises a mixture of two or more separate gas-evolving materials.

18. A method according to claim 1 wherein the desulfurizing agent contains as an additional component a strong deoxidizer.

19. A method according to claim 18 wherein the strong deoxidizer is aluminum.

20. A method according to claim 18 wherein the strong deoxidizer is calcium.

21. A method according to claim 1 wherein the fluidized desulfurization agent is withdrawn from the pressure vessel and introduced into the molten pig iron at a rate of between 80 and 140 kilograms per minute and the gas/solid ratio is maintained at a value in the range of 2 to 8 normal liters per kilogram.

22. A method according to claim 1 wherein the fluidized desulfurizing agent is withdrawn from the pressure vessel and introduced into the molten pig iron at a rate of between 100 and 120 kilograms per minute and the gas/solid ratio is maintained at a value in the range of 4 to 6 normal liters per kilgram.

* * * * *

UNITED STATES PATENT AND TRADEMARK OFFICE

CERTIFICATE OF CORRECTION

PATENT NO. : 3,955,966

DATED : May 11, 1976

INVENTOR(S) : Walter Meichsner

It is certified that error appears in the above-identified patent and that said Letters Patent are hereby corrected as shown below:

[63], line 2, delete "Pat. No. 3,807,602" and insert -- abandoned --.

[63], line 3, delete "abandoned" and insert -- Pat. No. 3,807,602 --.

Column 1, line 9, delete "U.S. Pat. No. 3,807,602" and insert -- abandoned --.

Column 1, line 12, delete "abandoned" and insert -- U.S. Pat. No. 3,807,602 --.

Signed and Sealed this

Thirty-first Day of August 1976

[SEAL]

*Attest:*

RUTH C. MASON
*Attesting Officer*

C. MARSHALL DANN
*Commissioner of Patents and Trademarks*